United States Patent [19]

Thorogood et al.

[11] Patent Number: 4,867,773

[45] Date of Patent: Sep. 19, 1989

[54] CRYOGENIC PROCESS FOR NITROGEN PRODUCTION WITH OXYGEN-ENRICHED RECYCLE

[75] Inventors: Robert M. Thorogood; Thomas M. Roden, both of Macungie; Jeffrey A. Hopkins, Whitehall, all of Pa.

[73] Assignee: Air Products and Chemicals, Inc., Allentown, Pa.

[21] Appl. No.: 254,527

[22] Filed: Oct. 6, 1988

[51] Int. Cl.[4] ..... F25J 3/00

[52] U.S. Cl. ..... 62/39; 62/42; 62/44

[58] Field of Search ..... 62/38, 39, 32, 36, 42, 62/44, 11

[56] References Cited

U.S. PATENT DOCUMENTS

| | | | |
|---|---|---|---|
| 4,152,130 | 5/1979 | Theobald | 62/18 |
| 4,222,756 | 9/1980 | Thorogood | 62/13 |
| 4,400,188 | 8/1983 | Patel et al. | 62/13 |
| 4,464,188 | 8/1984 | Agrawal et al. | 62/13 |
| 4,595,405 | 6/1986 | Agrawal et al. | 62/18 |
| 4,705,548 | 11/1987 | Agrawal et al. | 62/38 |
| 4,707,994 | 11/1987 | Shenoy et al. | 62/38 |

OTHER PUBLICATIONS

Celar et al., "Flexible Process of Pressure Nitrogen and Low Pressure Oxygen Production", Proceedings of XVIIth International Congress of Refrigeration, Vienna, 1987.

*Primary Examiner*—Ronald C. Capossela

*Attorney, Agent, or Firm*—Geoffrey L. Chase; James C. Simmons; William F. Marsh

[57] ABSTRACT

A process is set forth for recovery of nitrogen from a feed gas stream, containing nitrogen and oxygen, using a cryogenic separation wherein a recycle stream having an oxygen content above that of the feed gas stream is recycled separately and independent of the feed gas stream to the cryogenic separation zone without any intervening process step that would decrease the oxygen content of the recycle stream.

23 Claims, 3 Drawing Sheets

CRYOGENIC PROCESS FOR NITROGEN PRODUCTION WITH OXYGEN-ENRICHED RECYCLE

TECHNICAL FIELD

The present invention is directed to (he cryogenic separation of nitrogen from a feed gas stream containing nitrogen and oxygen. More specifically, the present invention is directed to recovering high purity nitrogen from air using a cryogenic separation with an unexpected efficiency increase achieved by appropriate recycle of a process stream.

BACKGROUND OF THE PRIOR ART

The use of nitrogen has become increasingly important in various industrial and commercial operations. For example, liquid nitrogen is used to freeze food, in the cryogenic recycling of tires and as a source of gaseous nitrogen for inerting. Gaseous nitrogen is used in applications such as secondary oil and gas recoveries and as a blanketing gas in metal refineries, metal working operations, semiconductor manufacture and chemical processes. In light of the increasing importance of nitrogen in such operations, it is desirable to provide a process which is both economical and efficient for producing nitrogen.

High purity gaseous nitrogen is produced directly by well known cryogenic separation methods. U.S. Pat. No 4,222,756 teaches a process and apparatus for producing gaseous nitrogen using multiple distillation columns and associated heat exchangers. Ruhemann and Limb, I. Chem. E. Symposium Series No. 79, page 320 (1983) advocate a preference for the use of the single distillation column instead of the typical double column for the production of gaseous nitrogen.

Liquid nitrogen is typically produced by initially producing gaseous nitrogen in a cryogenic air separation unit and subsequently treating the gaseous nitrogen in a liquefier. Modified forms of cryogenic air separation units have been developed to directly produce liquid nitrogen. U.S. Pat. No. 4,152,130 discloses a method of producing liquid oxygen and/or liquid nitrogen. This method comprises providing a substantially dry and substantially carbon dioxide-free air stream, cryogenically treating the air stream to liquefy a portion of the air stream, and subsequently feeding the air stream into a fractionation column to separate the nitrogen and oxygen and withdrawing liquid oxygen and/or nitrogen from said column.

Various process cycles using a single distillation column, with some boil-up at the bottom provided by the appropriate high pressure fluids, have also been suggested in the patent literature, for example, U.S. Pat. No. 4,400,188 and U.S. Pat. No. 4,464,188.

In U.S. Pat. No. 4,595,405 a process for the cryogenic separation of nitrogen from air is taught, wherein the cryogenic separation is conducted in a single pressure distillation column. The oxygen enriched waste gas from the cryogenic separation is rewarmed, compressed to an elevated pressure and processed through a selective membrane separation to extract oxygen from the waste stream for recovery or removal, while returning a nitrogen enriched stream to the cryogenic separation. This process entails the additional capital outlay for membrane separation. It would be logical in that patented process, designed for the recovery of nitrogen, to recycle a nitrogen-enriched stream, after membrane treatment to remove its predominantly oxygen content, as is performed in that patent.

In many of the cryogenic processes for recovery of nitrogen, the oxygen-enriched waste stream is removed from the cryogenic separation zone or distillation column and is reduced in pressure with the recovery of work in order to produce refrigeration for the feed stream being cooled for cryogenic separation. There is a minimum pressure at which such a process may be operated in order to provide sufficient refrigeration for the continuous operation of the process to produce gas. This pressure may be in excess of the pressure at which the product is required and thus there is an energy inefficiency in the production process. Alternatively, it is sometimes desirable to produce nitrogen at high pressure directly from the distillation system without further compression; for example in the production of nitrogen for the electronics industry. In this case, the combined flow and pressure of oxygen-enriched waste is often greater than is necessary to reduce in pressure with the recovery of work for the production of refrigeration. In this event, all of such waste cannot be processed accordingly without creating excess refrigeration. To avoid production of excess refrigeration, a portion of the waste stream is merely passed through an expansion valve, without the recovery of work, so as to minimize refrigeration production. This expansion without the recovery of work is a waste of the energy utilized to create the pressurized condition of that stream, as well as a waste of the nitrogen content of the stream.

The present invention overcomes the drawbacks of the prior art in producing high purity nitrogen using a cryogenic separation technique, wherein efficiencies are derived by the use of recycle and pressure maintenance of certain process streams as set forth below.

BRIEF SUMMARY OF THE INVENTION

The present invention is a process for the recovery of nitrogen from a feed gas stream containing nitrogen and oxygen whereby an oxygen-enriched recycle stream is returned to the cryogenic separation zone for further processing to recover additional nitrogen, comprising the steps of: compressing a feed gas stream containing nitrogen and oxygen to an elevated pressure, introducing the elevated pressure feed gas stream into a cryogenic separation zone to recover a high purity nitrogen product and an oxygen-enriched waste stream from said zone, removing a recycle stream having an oxygen content above that of the feed gas stream from said cryogenic separation zone, and without any intervening process steps to decrease the oxygen content of said recycle stream, recycling said stream separately and independent of the feed gas stream to the cryogenic separation zone.

Preferably, said feed gas stream is air. Additionally, said recycle stream can be at least a portion of said oxygen-enriched waste stream.

Preferably said feed gas stream is pretreated to remove water and carbon dioxide. Said recycle stream is recompressed to at least said pressure of the cryogenic separation zone and reintroduced to said cryogenic separation zone without any need for treatment to remove water and carbon dioxide.

Preferably said high purity nitrogen product has a nitrogen content of at least 95%. Alternatively, said high purity nitrogen product has a nitrogen content of at least 99.5% and typically 99.99%.

In one embodiment of the process, a portion of said oxygen-enriched waste stream is let down in pressure across an expander with the recovery of work to produce refrigeration for said cryogenic separation zone. Optimally, a second portion of said waste stream is recycled as said recycle stream.

In a second embodiment of the invention, the distillation column of the cryogenic separation zone is operated at the lowest pressure commensurate with a portion of the oxygen-enriched waste being discharged directly to atmosphere at substantially ambient pressure. In this case it is necessary to provide refrigeration for operation of the process by a work expansion of a compressed portion of either the oxygen-enriched recycle stream or the feed gas stream.

A preferred embodiment of the present invention is a process for the recovery of nitrogen from a feed air stream in which the proportion of nitrogen recovered from the feed gas stream is increased by recycling a portion of an oxygen-enriched waste stream to a position a few stages below that of the feed gas stream to the distillation column of the cryogenic separation zone, comprising the steps of: compressing a feed air stream to an elevated pressure, pretreating said feed air stream to remove water and carbon dioxide therefrom, cooling the feed air stream by heat exchange against rewarming process streams, introducing said cooled feed air stream into a cryogenic distillation zone, separating said feed air stream in said distillation zone into a high purity nitrogen product and an oxygen-enriched waste stream having an oxygen content above that of the feed air stream, reducing the pressure on a first portion of the said waste stream by passage through a turbine expander to produce refrigeration for cooling the feed air stream, and recycling a second portion of said waste stream to the cryogenic distillation zone without substantial pressure reduction before recompression and without any intervening process step to decrease the oxygen content of said recycled second portion of said waste stream.

Preferably, said cryogenic distillation zone has a single pressure stage distillation column.

preferably, an oxygen-enriched stream is removed from the base of said cryogenic distillation zone and is vaporized against a condensing nitrogen-rich stream removed from the top of said cryogenic distillation zone to produce reflux for said cryogenic distillation zone.

Alternatively, the process refrigeration may be provided by work expansion of a compressed portion of the recycled waste stream or of the feed gas stream.

Alternatively, liquid nitrogen product can be produced from the process of the present invention either with or without gaseous nitrogen product. Additionally, the high purity nitrogen product can be rewarmed against the feed air stream and the recycle stream. If needed, a third portion of said waste stream is bypassed around said expander and reduced in pressure without the recovery of work.

DETAILED DESCRIPTION OF THE INVENTION

Figure 1:
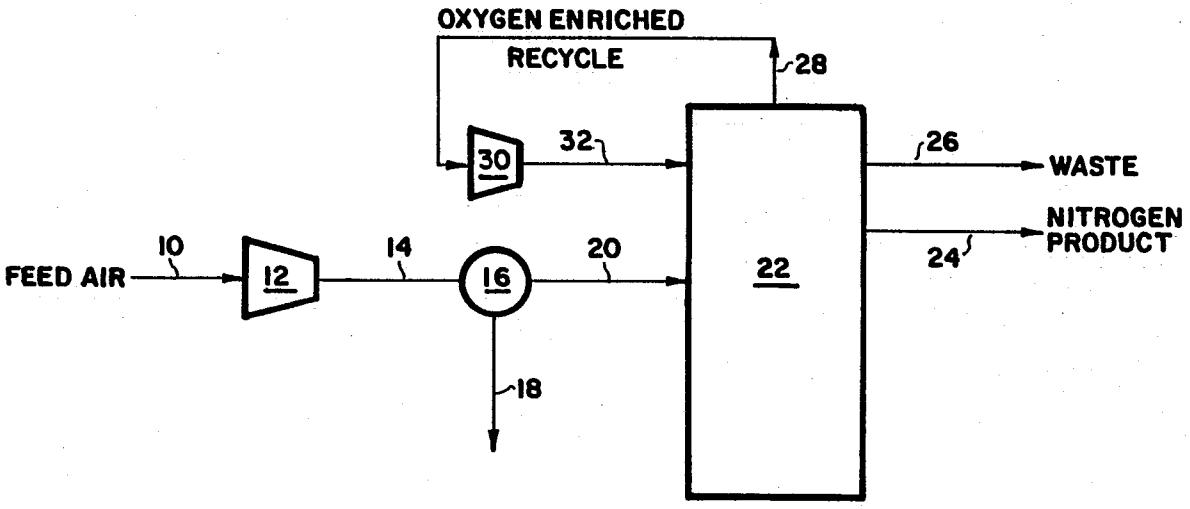
FIG. 1 is a schematic illustration of the process of the present invention.

The present invention is an efficient means to recover additional nitrogen from the oxygen-enriched waste stream produced in a single distillation column nitrogen production cryogenic separation plant. The process provides this efficiency by recycling a part of the oxygen-enriched, nitrogen-depleted stream for further separation in the lower portion of the distillation column. No pressure loss or composition change is incurred in the recycled waste stream. The operating parameters of the process may be adjusted to achieve operation with a minimum flow of expander bypass to achieve a minimum power consumption for nitrogen production at the desired product pressure. Alternative provision is made for production of process refrigeration by work expansion of either the waste oxygen-enriched stream to atmosphere or of the compressed recycle stream or feed gas stream, depending upon the pressure of required product nitrogen for the process.

For nitrogen producing cryogenic plants in the size range of 30 to 250 tons/day (T/D), energy costs and capital-related investment cost play approximately equally important roles in the cost of producing nitrogen. The present invention increases the energy efficiency of such plants from 7 to 19% with small increases in capital investment.

In nitrogen producing cryogenic air separation plants of the above size range, nitrogen is typically produced at elevated pressure from air by cryogenic distillation in a single distillation column operating at a single elevated pressure. When nitrogen is produced at high pressure, the oxygen enriched waste stream from the column is also required to be produced at an elevated pressure greater than ambient pressure but less than the final feed gas pressure. This waste stream is expanded across an expander with recovery of work to provide refrigeration for the cryogenic facility. However, a large fraction of this gas is reduced in pressure across an expander bypass valve (J. T. valve) without the recovery of work to avoid producing excess refrigeration. This is an inefficient step from the perspective of energy utilization. In contrast, in one embodiment of the present invention the flow of the waste stream through the expander bypass valve is decreased. Instead, some of this elevated pressure, oxygen-enriched waste stream at a pressure intermediate between ambient and final feed gas pressure is brought out of the cryogenic separation facility or cold box and recompressed and recycled to the cryogenic separation zone. This allows the recovery of some of the pressure energy and the nitrogen content in the oxygen-enriched, nitrogen-depleted waste stream. The present invention accomplishes this goal by compressing at least a part of this waste stream and returning it as an oxygen-enriched stream to the distillation column for further cryogenic separation. The oxygen-enriched waste stream should be at a pressure greater than ambient prior to compression and recycle to the cryogenic separation.

In a second mode of operation for the production of nitrogen at low pressure (below about 7 psia), the distillation column is operated at a pressure to permit the reboiler to discharge oxygen-enriched waste gas directly to atmosphere without pressure reduction. A portion of the waste gas is recompressed so that it may be work expanded prior to being recycled to the distillation column. By this means, the process operates at its lowest practicable pressure and substantially below that of the conventionalprocess employing work expansion of the waste stream from the distillation column reboiler. Thus the process of this invention is able to operate with a greater energy efficiency than the previously known process. A further alternative to accomplish this same benefit is to provide the process refrigeration by compression of a portion of the feed gas to the process and to work expand this said portion prior to feed to the distillation column.

In all of these processes a greater overall efficiency is obtained, with improvements in overall nitrogen recovery based upon the fresh feed to the cryogenic separation zone, and minimization of capital requirements.

The main aspects of the present invention can be briefly described with reference to FIG. 1. A feed gas stream containing nitrogen and oxygen, preferably air, is introduced in line 10 to a main feed gas compressor 12 which typically has several stages of compression with intercooling. The feed gas stream at elevated pressure in line 14 is then pretreated in a pretreatment zone 16 to remove water, carbon dioxide and any hydrocarbons existing in the feed gas stream. These materials are removed in line 18. Typical pretreatment plants can include water chilling, refrigeration with a halofluorocarbon, such as a FREON refrigerant, as well as adsorption of residual materials on switching beds of molecular sieve material, all of which techniques are well documented in the prior art and require no specific disclosure herein.

The feed gas stream, at elevated pressure after pretreatment, is introduced in line 20 to a cryogenic separation zone 22. The cryogenic separation zone typically includes main and auxiliary heat exchangers wherein the feed gas stream is cooled close to its dew point by indirect heat exchange with rewarming process streams, as well as a distillation column, and a work producing gas expansion engine. A nitrogen product is removed in line 24 and can comprise gaseous nitrogen, and/or a separately recovered product of liquefied nitrogen. A waste stream comprising an oxygen-enriched gas is removed in line 26. Specifically with regard to the present invention, an oxygen-enriched, nitrogen-depleted stream is removed from the cryogenic separation zone 22 in line 28 and is recompressed in compressor 30 and returned to the cryogenic separation zone through line 32 without any intervening process steps to reduce its oxygen content. The composition of this recycle stream 28 may or may not be the same as that of the waste stream in line 26, and its oxygen content will be above that of the feed gas.

FIG. 1 illustrates the recycle to a compressor 30. For this purpose, it may be beneficial to boost the pressure of streams 28 or 32 by an additional booster compressor. Power for this additional compression can be derived from the expansion in an expander of the oxygen-enriched waste.

The advantage of performing the process as illustrated in FIG. 1 is that the oxygen-enriched stream of line 28 would traditionally be reduced in pressure either for refrigeration or through a bypass JT valve in the prior art during the process of removal of such a waste stream in a nitrogen generating process. This either incurs an energy inefficiency due to the bypass flow when the process is operated for a high pressure nitrogen product or has a minimum operating pressure for low pressure nitrogen product determined by the minimum pressure required for process refrigeration. The present invention allows the process to be operated at its optimum efficiency for the required nitrogen product pressure by adjusting the flow and pressure available for work expansion without the need for an inefficient pressure reduction in a bypass stream. The provision of the oxygen-rich recycle gives additional cryogenic separation to efficiently recover nitrogen as product which would otherwise be lost in the waste stream. The waste stream in line 26 may also constitute a desirable product stream if oxygen concentrations meet end use applications.

The unexpected result of the present invention is that the recycling of a stream, enriched in oxygen and for which the energy of separation to produce nitrogen must be greater than for a corresponding increment of feed gas, achieves a considerable improvement in the overall efficiency of the separation process for productin of nitrogen at both low and high pressures. The inefficiency of the additional separation is less than the inefficiency of the work expansion process with its associated bypass in the previously known process.

The present invention will now be described with reference to a preferred embodiment for the production of high pressure nitrogen illustrated in FIG 2. A feed air stream 210 is introduced into a multistage main air compressor 212 and elevated in pressure to approximately 124 psia in line 214. The feed gas stream is cooled by indirect heat exchange with cooling water in aftercooler 213. The feed gas stream is further cooled in a refrigerated heat exchanger 215 to condense water, which is removed in phase separation vessel 217. Residual water and carbon dioxide, as well as trace hydrocarbons, are removed from the feed gas stream in a mole sieve switching bed adsorption system 219, wherein the feed is passed through one parallel bed until regeneration is required and then the feed is switched to pass through the other bed while regeneration occurs. Such a switching adsorptive clean-up is well known in the art and does not require greater elaboration. The aftercooler 213, the refrigerated cooler 215, the phase separation vessel 217 and the switching adsorptive beds 219 collectively constitute a pretreatment stage 216.

The elevated pressure, clean and dry feed gas stream in line 220 is then introduced into the main heat exchanger 223 to be cooled against rewarming gaseous nitrogen, a recycle stream and a waste stream. The cooled feed gas stream a −269° F. is introduced in line 225 into a single pressure stage distillation column 227 which is constructed with the appropriate means for countercurrent rectification. Vapor which is slowy enriching in nitrogen ascends the column 227, while liquid slowly enriching in oxygen descends the column. An oxygen enriched stream is removed from the base of the column 227 in line 237 and reduced in pressure through valve 239 before being introduced to the reboiler compartment overhead of the column to provide cooling by indirect heat exchange in a boiling/condensing heat exchanger 231. Vaporous nitrogen enriched gas passes from the distillation column 227 overhead into the heat exchanger 231 and is condensed against the rewarming oxygen-enriched gas and is returned as liquid for reflux in line 233, a liquid nitrogen product (LIN) may be removed in line 235. The remaining vaporous nitrogen having a high purity of at least 95%, and preferably at least 99.5% and more usually 99.99%, is removed in line 229 and rewarmed in the main heat exchanger 223 against the feed air stream in line 220 and recycle stream in line 236. The high purity rewarmed nitrogen gas (GAN) is removed as a product at a pressure of 115 psia in line 224.

The vaporized oxygen-enriched gas from the overhead boiling/condensing heat exchanger 231 is removed in line 243 at a pressure of 46 psia and −283° F. This stream is utilized to produce the refrigeration for the cryogenic separation. To achieve this refrigeration, a first portion of the waste stream in line 243 is removed in line 245 for pressure reduction. The remaining waste stream in line 247 is partially rewarmed in the main heat exchanger 223 before some of the remaining waste is separated in line 249 for combination with the first portion in line 245, which is combined in line 251. Most of the waste stream in line 251 is reduced in pressure with the recovery of work by expanding in an expander turbine 257 resulting in significant cooling of the resulting low pressure gas. A third portion of the waste gas stream in line 253 is bypassed around the expander turbine 257 and is reduced in pressure without recovery of work in a bypass valve operating with the Joule-Thompson effect identified as 255. This bypassed third portion of the waste stream is reduced in pressure without recovery of work in order to avoid excess refrigeration and is combined with the turbine-expanded waste stream in line 259. This waste stream in line 259 comprises the main refrigeration source in the main heat exchanger 223, wherein the gas is rewarmed against the cooling feed gas stream in line 220. The low pressure oxygen-enriched waste gas stream is removed in line 226 and vented. A portion of this stream 226 can be used to regenerate molecular sieve pretreatment beds if they are included in the facility. Stream 226 could also be a useful product if its oxygen content is appropriate for end use applications.

A second portion of the oxygen-enriched waste gas stream is diverted around the pressure reduction valve 255 and expander turbine 257 and without any further process steps, such as membrane separation which would affect or specifically decrease the oxygen content of the gas, is passed via line 228 to recycle compressor 230 where its pressure is increased to approximately 125 psia. From there, the compressed gas in line 232 is indirectly cooled by water in heat exchanger 234. The cooled recycle stream is then returned to heat exchange 223 via pipe 236.

In the heat exchanger, the recycle stream with an oxygen content of about 57% in nitrogen is cooled to approximately −258° F. when it is passed via pipe 238 to the single pressure distillation column 227. The recycle stream enters the distillation column several distillation stages below the air feed at the same location where the oxygen rich liquid waste stream is withdrawn. A purge stream can be removed from the reboil compartment in line 241.

Although it would appear inconsistent in a nitrogen recovery cryogenic separation to return an oxygen-enriched stream to the cryogenic separation zone, it has been unexpectedly found by the present inventors that the recited recycle reduces the relative power requirements of the process over a cycle with no recycle and substantially increases the recovery of nitrogen based upon fresh air feed to the overall process. The inefficiency of performing the recycle is found to be less than the inefficiency of reducing the pressure of the recycle stream across the JT valve 255 and venting that stream as a waste stream. This advantage is manifested in the relationship between the distillation column 227, the refrigeration source 255 and 257, and the main heat exchanger 223, all of which make up the cryogenic separation zone or cold box.

In order to demonstrate the valu of performing a recycle of an oxygen-enriched waste gas stream to the cryogenic separation zone, the following comparison of the prior art without recycle is made with two embodiments of the present invention utilizing such a recycle.

EXAMPLE 1

Figure 2:
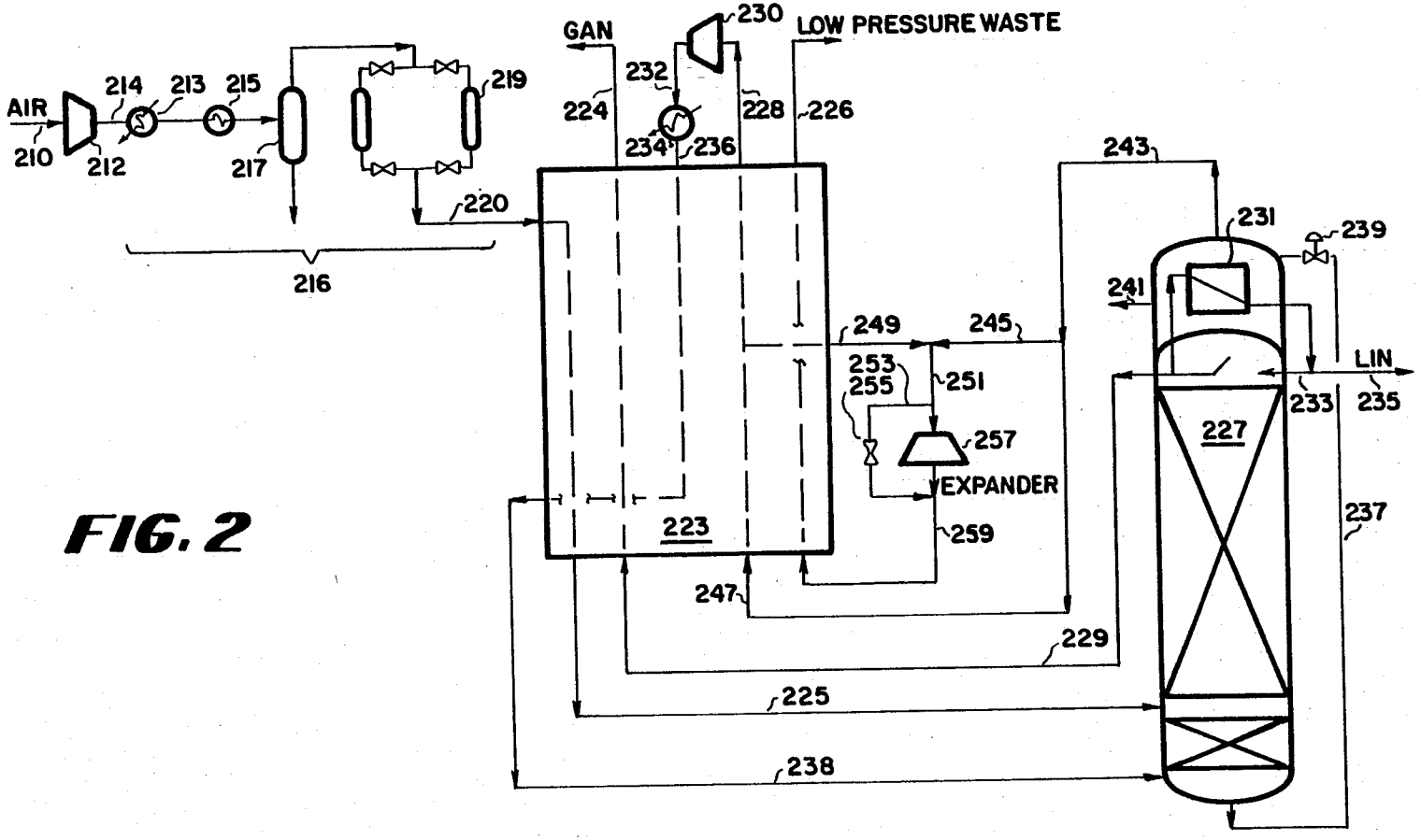
FIG. 2 is a schematic illustration of one embodiment of the present invention for production of nitrogen at high pressure.

Calculations were done by computer simulation of a process as shown in FIG. 2 wherein no recycle in line 228 was performed and some of the waste gas is expanded across expander 257 and the remaining waste gas is passed through the bypass valve 255. The inefficiency herein is due to the gas required to be passed through the bypass valve 255 without recoupment of energy and which is thereafter merely vented from the process. The calculation produced 87 T/D of gaseous nitrogen at 115 psia. The ambient conditions used were 14.7 psia, 70° F., and 50% relative humidity. Some of the pertinent results are illustrated in Table 1 below. It is seen that a large flow (about 40% of the feed air) bypasses the expansion turbine and the amount of nitrogen recovered relative to the total nitrogen contained in the feed air is 53.1%.

EXAMPLE 2

In this example, computer simulation calculations were done according to the present invention as embodied in the process shown in FIG. 2. These examples included the recycle of a portion of the waste stream in line 228 without any attempt to decrease the oxygen enriched character of the stream. The product flow and purity, ambient conditions and number of distillation stages were the same as those given for Example 1 above. In this process, the amount of the recycle stream 228 can be controlled. When a smaller amount is recycled, a larger amount of flow is expanded across the expander bypass valve and vice versa. The concentration of oxygen in the recycle stream is also dependent on the recycle flow. The concentration of oxygen increases with an increase in the recycle flow and decreases with a decrease in the recycle flow. Two cases were performed for different recycle flows by computer simulation and the results are compared with Example 1 as shown in Table 1.

It is apparent in Table 1 that the new recycle process of Example 2 achieves a considerable reduction of the total specific power for production of nitrogen at 115 psia from 0.673 kwh/100 scf in Example 1 to 0.554 and 0.542 kwh/100 scf respectively for Cases 1 and 2 of Example 2. This is a percentage reduction of 17.4 to 19.2%. As the expander bypass flow is reduced from Example 1 to Example 2 Case 2 it can be seen that there is a corresponding increase of process efficiency.

TABLE 1

Pertinent Calculation Results for Examples 1 & 2
Product: 87 T/D GAN at 115 psia, 99.99% $N_2$

| | | Example 2 | |
|---|---|---|---|
| | Example 1 | Case I | Case II |
| Oxygen in Waste (%) (Stream 26 or 226) | 35.8 | 50.5 | 56.3 |
| Recycle Stream Flow (lb moles/hr) (Stream 28 or 228) | — | 171 | 199 |

TABLE 1-continued

Pertinent Calculation Results for Examples 1 & 2

Product: 87 T/D GAN at 115 psia, 99.99% $N_2$

| | Example 1 | Example 2 Case I | Example 2 Case II |
|---|---|---|---|
| Expander Bypass Flow (lb moles/hr) (Stream 253) | 250 | 59 | 16 |
| Feed Air Flow (lb moles/hr) (Stream 10 or 210) | 623 | 442 | 413 |
| $N_2$ Recovery as % of $N_2$ in Air Feed | 53.2 | 75.5 | 80.6 |
| Specific Power (kwh/100 scf $N_2$) for product | 0.673 | 0.554 | 0.542 |
| Relative Power | 1.0 | 0.826 | 0.808 |

The prior art processes which fail to use a recycle stream are a tradeoff between capital and energy costs. In a plant size in the range of 30 to 250 T/D of nitrogen contained in the product gas, any process is designed to minimize the number of equipment items of significant capital cost. As a result, in order to produce high pressure, gaseous nitrogen product, no gaseous nitrogen compressor is used. Also, in certain applications, due to the possibility of contamination of the gaseous nitrogen, it is not advisable to use a product compressor on ultra high purity nitrogen from the cryogenic separation zone. Either of these considerations leads to a process with significant energy losses, since a substantial amount of oxygen-enriched waste gas muxt be expanded across a bypass valve, with a corresponding process inefficiency. In contrast, the present invention provides a scheme to limit the amount of gas expanded across this valve, without significant additional capital requirements, such as the membrane used in the prior art, which nitrogen enriches the waste which it recycles. Instead, the present invention is designed to take a significant fraction of the oxygen-enriched waste gas out of the cryogenic separation zone at a high pressure and after recompression returns this stream for further separation in the cryogenic separation zone. This allows this process of the present invention to take advantage of reduced power requirements, comparable capital costs, and increased recovery in comparison to the prior art when producing nitrogen at high pressure above about 75 psia.

A second application of the invention is for production of nitrogen at low pressure (below about 70 psia). This second embodiment will now be described with reference to FIG. 3. A feed air stream 310 is introduced into a multistage main air compressor 312 and elevated in pressure to approximately 61.3 psia in line 314. The feed stream is cooled by indirect heat exchange with cooling water in aftercooler 313. The feed stream is further cooled in a refrigerated heat exchanger 315 to condense water, which is removed in phase separation vessel 317. Residual water and carbon dioxide, as well as trace hydrocarbons, are removed from the feed gas stream in a mole sieve switching bed adsorption system 319, wherein the feed is passed through one parallel bed until regeneration is required and then the feed is switched to pass through the other bed while regeneration occurs. Such a switching adsorptive clean-up is well known in the art and does not require greater elaboration. The aftercooler 313, the refrigerated cooler 315, the phase separation vessel 317 and the switching adsorptive beds 319 collectively constitute a pretreatment stage 316.

The elevated pressure, clean and dry feed air stream in line 320 is then introduced into themain heat exchanger 323 to be cooled against rewarming gaseous nitrogen, a recycle stream and a waste stream. The cooled feed gas stream at −288.7° F. is introduced in line 325 into a single pressure stage distillation column 327 which is constructed with the appropriate components for countercurrent rectification. Vapor which is slowly enriching in nitrogen ascends the column 327, while liquid slowly enriching in nitrogen ascends the column. An oxygen-enriched stream is removed from the base of the column 327 in line 337 and reduced in pressure through valve 339 before being introduced to the reboiler compartment of the column to provide cooling by indirect heat exchange in a boiling/condensing heat exchanger 331. Vaporous nitrogen enriched gas passes from the distillation column 327 overhead into the heat exchanger 331 and is condensed against the rewarming oxygen-enriched gas and is returned as liquid for reflux in line 333. A liquid nitrogen product (LIN) may be removed in line 335. The remaining vaporous nitrogen having a high purity of at least 95%. preferably at least 99.5% and more usually 99.99%, is removed in line 329 and rewarmed in the main heat exchanger 323 against the feed air stream in line 320 and the recycle stream in line 336. The high purity rewarmed nitrogen gas (GAN) is removed as a product at a pressure of 52 psia in line 324.

The vaporized oxygen-enriched gas from the overhead boiling/condensing heat exchanger 331 is removed in line 343 at a pressure of −16.5 psia and −301.5° F. The waste stream in line 343 with an oxygen content of about 58.3% is rewarmed in the main heat exchanger 323. A part of the waste is separated in line 350 to be vented to atmosphere. The other part of the waste stream in line 352 is recompressed by compressor 330 and elevated in pressure to approximately 162.5 psia. The stream, in line 332, is then cooled by indirect heat exchange with water in aftercooler 334. The compressed recycle gas 336 is then cooled in heat exchanger 323 to a temperature of approximately −233.4° F. The stream, now in line 337, is then further cooled by reduction of pressure in expander turbine 357 with recovery of work. The expanded waste stream in line 338 is passed to the single pressure distillation column 327. The recycle stream enters the distillation column several distillation stages below the air feed at the same location where the oxygen rich liquid waste stream is withdrawn. A purge of the reboil/condenser compartment can be removed in line 341.

In order to demonstrate performing a recycle of an oxygen-enriched waste gas stream to the cryogenic separation zone, the following comparison of the prior art without recycle is made with an embodiment of the present invention using such a recycle.

EXAMPLE 3

Calculations were done by computer simulation of a process as shown in FIG. 2 wherein no recycle in line 228 was performed and some of the waste gas is expanded across expander 257. The operating pressure of the process was reduced until a negligible bypass flow was required. The process thus operated at maximum efficiency and at the lowest possible pressure. The calculation produced 87 T/D of gaseous nitrogen at 66 psia. The ambient conditions used were 14.7 psia, 70° F., and 50% relative humidity. Some of the pertinent results are illustrated in Table 2 below. It is seen that a negligible flow bypasses the expansion turbine and the amount of nitrogen recovered relative to the total nitrogen contained in the feed air is 60.2%.

EXAMPLE 4

Figure 3:
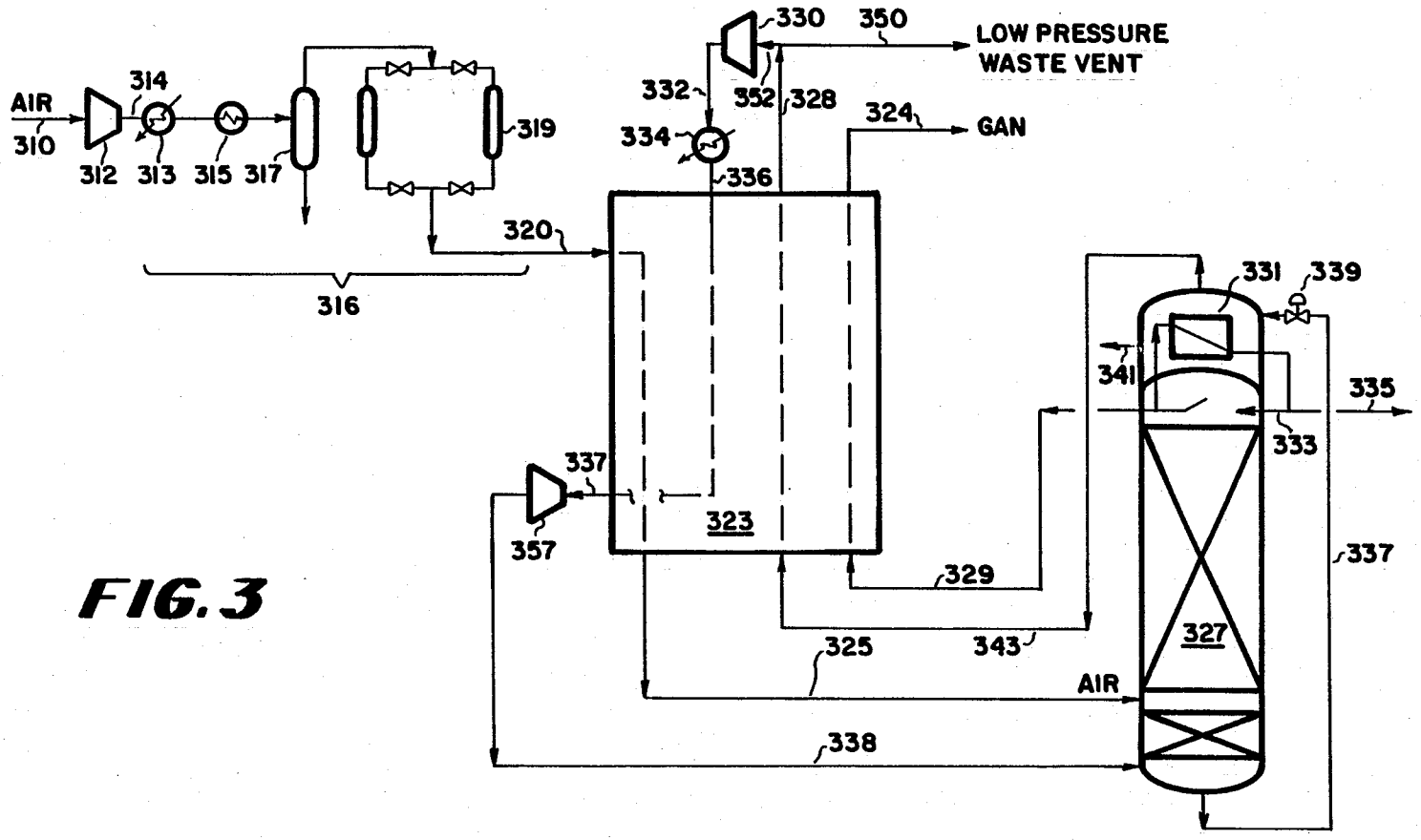
FIG. 3 is a schematic illustration of a second embodiment of the present invention for production of nitrogen at low pressure.

In this example, computer simulation calculations were done according to the present invention as embodied in the process shown in FIG. 3. This example included the recycle of a portion of the waste stream in line 328 without any attempt to decrease the oxygen enriched character of the stream. The product flow and purity, ambient conditions and number of distillation stages were the same as those given for Example 3 above. In this process, the amount of the recycle stream 352 can be controlled. When a smaller amount is recycled, a larger pressure is required for the feed to the expansion turbine and vice versa. The concentration of oxygen in the recycle compressor discharge is also dependent on the recycle flow. The concentration of oxygen increases with an increase in the recycle flow and decreases with a decrease in the recycle flow. The following case was performed for an optimized recycle flow by computer simulation and the results are compared with Example 3 as set forth below. In order to maximize the efficiency of the process, the reboiler-condenser 331 is operated at a minimum pressure such that the waste stream 350 can be vented to atmosphere without pressure loss. This determines the operating pressure of the distillation column and thus the minimum pressure for product produced in line 324.

In this embodiment, 117 pound moles/hr of the oxygen-enriched, nitrogen-depleted waste gas stream containing about 58.3% oxygen is recycled to the cryogenic separation zone. There is no flow through the expander bypass valve as is also the case for Example 3. Due to the recycle flow, the amount of feed air flow is decreased to 405 pound moles/hr. at a pressure of 61.3 psia. At these conditions, nitrogen can be efficiently produced at a low product pressure of only 52 psia. This is more than 21% below the minimum operating pressure for Example 3, and thus allows a substantial power reduction for nitrogen production cases where a low product pressure is sufficient. As seen from Table 2, the power consumed by this Example 4 is about 6.8% lower than the calculated power for Example 3 at its minimum operating pressure. This comparison is set forth in Table 2.

In Example 4, the refrigeration requirements of the process have been provided by compression and work expansion of the recycle stream. The refrigeration may alternatively be provided by compression and work expansion of a part of the air feed stream. In this latter case, the recycle stream is only compressed to a sufficient pressure to return it to the cryogenic separation zone. The efficiency of such a process is essentially identical to that of Example 4, although additional compression machinery is required.

Although it would again appear inconsistent in a nitrogen recovery cryogenic separation process to return an oxygen enriched stream to the cryogneic separation stage, it has again been unexpectedly found by the present inventors that the recited recycle reduces the relative power requirements of the process over a cycle with no recycle and substantially increases the recovery of nitrogen based upon fresh air feed to the overall process. In this second embodiment, the invention is compared to the operation of the conventional non-recycle process at conditions in which no expander bypass is required and the process is operated at the minimum pressure which is required to sustain a refrigeration balance for the cold box. The recycle offers a means to operate the new process at a pressure substantially below the aforesaid minimum and also achieves a verymuch greater recovery of nitrogen, which combination achieves a substantial improvement of the process efficiency for low pressure nitrogen product. This advantage is derived from he relationship between the distillation column 327, the refrigeration source 357, and the main heat exchanger 323, all of which make up the cryogenic separation zone or cold box.

It is apparent in Table 2 that the new recycle process of Example 4 achieves a significant reduction of the total specific power for production of nitrogen at 52 psia from 0.474 kwh/100 scf in Example 3 to 0.442 kwh/100 scf in Example 4. This is a percentage reduction of 6.8%. It is also apparent by comparison with Table 1 that the specific power in both Examples 3 and 4 is below that of Examples 1 and 2. This is due to the reduced pressure of product $N_2$ and to the improved efficiency of Examples 3 and 4 which have negligible expander bypass flow and, therefore, improved process efficiency.

The unexpected improved performance of Example 4 over Example 3 is due to the benefits derived from the recycle process, which allows a lower operating pressure for the process to be achieved without also giving an increase of nitrogen recovery from the fresh feed air. This combination achieves a reduction of specific power for the product nitrogen.

Thus the benefit of the present invention may be derived in two ways. In the case of high pressure nitrogen production, the inefficiency of the waste expander bypass pressure reduction is avoided by recycling the pressurized stream to the process for further distillative separation, thus utilizing the energy efficiently. For the case of low pressure nitrogen production, the conventional low pressure process has a limited lower operating product pressure of approximately 68 psia. The new process can operate efficiently and with a lower energy consumption to produce product at lower pressure, down to about 52 psia by achieving a higher product recovery from the air feed.

The scope of the present invention should be ascertained from the claims which follow:

We claim:

1. A process for the recovery of nitrogen from a feed gas stream containing nitrogen and oxygen whereby an oxygen-enriched recycle process stream is returned to the cryogenic separation zone comprising the steps (a) compressing a feed gas stream containing nitrogen and oxygen to an elevated pressure;

(b) introducing the elevated pressure feed gas stream into a cryogenic separation zone to recover a high purity nitrogen product and an oxygen-enriched waste stream from said zone, and (c) removing a recycle stream, having an oxygen content above that of the feed gas stream of step (a), from said cryogenic separation zone and at least maintaing the oxygen content of said recycle stream, recycling said stream separately and independent of the feed gas stream to the cryogenic separation zone.

2. The process of claim 1 wherein said feed gas stream is air.

3. The process of claim 1 wherein said recycle stream is at least a portion of said oxygen-enriched waste stream.

4. The process of claim 1 wherein said recycle stream is introduced in said cryogenic separation zone at a location one or more stages below the feed gas stream to a distillation column of the cryogenic separation zone.

5. The process of claim 1 wherein said elevated pressure feed gas stream is pretreated to remove water, carbon dioxide and other contaminants.

6. The process of claim 1 wherein said high purity nitrogen product has a nitrogen content of at least 95% nitrogen by volume.

7. The process of claim 1 wherein said high purity nitrogen product has a nitrogen content of at least 99.5% nitrogen by volume.

8. The process of claim 1 wherein a portion of said oxygen-enriched waste stream is expanded through an expander to extract work and produce refrigeration for said cryogenic separation zone.

9. The process of claim 8 wherein a second portion of said waste stream is recycled as said recycle stream without reduction in the oxygen concentration.

10. The process of claim 9 wherein nitrogen is produced at a pressure in excess of 75 psia.

11. The process of claim 1 wherein a portion of said oxygen-enriched waste stream is vented directly to atmosphere, the remaining part is compressed and recycled to the cryogenic distillation zone, and refrigeration is provided for the process by compressing and work expanding a part of the feed gas before passing it to the cryogenic distillation zone.

12. A process for the recovery of nitrogen from a feed gas stream comprising air whereby a portion of an oxygen-enriched waste stream is recycled, comprising the steps of:

(a) compressing feed gas stream to an elevated pressure;
(b) pretreating said feed gas stream to remove water and carbon dioxide therefrom;
(c) cooling the feed gas stream by heat exchange against a rewarming process stream;
(d) introducing said cooled feed gas stream into a cryogenic distillation zone;
(e) separating said feed gas stream in said distillation zone into a high purity nitrogen product and an oxygen-enriched waste stream having an oxygen content above that of air;
(f) reducing the pressure on a first portion of said waste stream by expanding through an expander with the recovery of work to produce refrigeration for step (c); and
(g) compressing and recycling a second portion of said waste stream separately and independent of the feed gas stream to the cryogenic distillation zone while at least maintaining the oxygen content of said recycled second portion of said waste stream.

13. The process of claim 12 wherein said feed gas stream is air.

14. The process of claim 12 wherein said recycle stream is introduced into said cryogenic distillation zone at a location one or more stages below the feed gas stream to the distillation zone.

15. The process of claim 12 wherein said high purity nitrogen product has a nitrogen content of at least 95% nitrogen by volume.

16. The process of claim 12 wherein said high purity nitrogen product has a nitrogen content of at least 99.5% nitrogen by volume.

17. The process of claim 12 wherein nitrogen is produced at a pressure in excess of 75 psia.

18. A process for the recovery of nitrogen from a feed gas stream comprising air whereby an oxygen-enriched waste stream is recycled, comprising the steps of:

(a) compressing a feed gas stream to an elevated pressure;
(b) pretreating said feed gas stream to remove water and carbon dioxide therefrom;
(c) cooling the feed gas stream by heat exchange against a rewarming process stream;
(d) introducing said cooled feed gas stream into a cryogenic distillation zone;
(e) separating said feed gas stream in said distillation zone into a high purity nitrogen product and an oxygen-enriched waste stream having an oxygen content above that of air;
(f) venting to atmosphere a first portion of said waste stream; and
(g) compressing and recycling a second portion of said waste stream by compressing the gas and expanding at least a portion through an expander with the recovery of work to produce refrigeration for step (c) and returning said second portion to the cryogenic distillation zone separately and independent of the feed gas stream.

19. The process of claim 18 wherein said feed gas stream is air.

20. The process of claim 18 wherein said recycle stream is introduced into said cryogenic distillation zone at a location one or more stages below the feed gas stream to the distillation zone.

21. The process of claim 18 wherein said high purity nitrogen product has a nitrogen content of at least 95% nitrogen by volume.

22. The process of claim 18 wherein said high purity nitrogen product has a nitrogen content of at least 99.5% nitrogen by volume.

23. The process of claim 18 wherein nitrogen is produced at a pressure below 75 psia.

* * * * *

UNITED STATES PATENT AND TRADEMARK OFFICE

CERTIFICATE OF CORRECTION

PATENT NO. : 4,867,773

DATED : September 19, 1989

INVENTOR(S) : Thorogood, et al

It is certified that error appears in the above-identified patent and that said Letters Patent is hereby corrected as shown below:

Column 12, Line 50
After "steps" insert -- of: --
Column 13, Line 36
After "compressing" insert -- a --

Signed and Sealed this

Twelfth Day of February, 1991

*Attest:*

HARRY F. MANBECK, JR.

*Attesting Officer*

*Commissioner of Patents and Trademarks*